US005630244A

United States Patent [19]

Chang

[11] Patent Number: 5,630,244

[45] Date of Patent: May 20, 1997

[54] ELASTIC TOOTHBRUSH

[76] Inventor: Ching-Min Chang, 58, Ma Yuan West St., Taichung, Taiwan

[21] Appl. No.: 581,986

[22] Filed: Jan. 2, 1996

[51] Int. Cl.[6] ..... A46B 9/04

[52] U.S. Cl. ..... 15/167.1; 15/143.1; 15/144.1; 15/172; D4/104; D4/138

[58] Field of Search ..... 15/143.1, 144.1, 15/167.1, 172; D4/104, 138

[56] References Cited

U.S. PATENT DOCUMENTS

| | | | |
|---|---|---|---|
| 5,052,071 | 10/1991 | Halm | 15/167.1 |
| 5,054,154 | 10/1991 | Schiffer et al. | 15/167.1 |
| 5,339,482 | 8/1994 | De Simone | 15/167.1 |
| 5,398,369 | 3/1995 | Heinzelman et al. | 15/167.1 |

FOREIGN PATENT DOCUMENTS

| | | | |
|---|---|---|---|
| 310482 | 4/1989 | European Pat. Off. | 15/167.1 |
| 611533 | 8/1994 | European Pat. Off. | 15/167.1 |
| 6712131 | 3/1968 | Netherlands | 15/144.1 |

*Primary Examiner*—Mark Spisich

[57] ABSTRACT

An elastic toothbrush comprises a head, a neck, a connector, and a handle. A slot and a groove are on the upper surface of the handle. An elongated recess is on the lower surface of the handle. An anti-skid rubber infills the slot. A rubber mark infills the groove. A non-slip rubber infills the elongated recess. A circular recess is formed between the head and the neck. A notch is formed on the distal end of the head. An upper and lower recesses are formed on the rim of the head. The end rubber infills the notch. The circular rubber infills the circular recess. The rim rubber infills the upper and lower recesses. The connector is enclosed by a connector rubber.

5 Claims, 10 Drawing Sheets

ELASTIC TOOTHBRUSH

BACKGROUND OF THE INVENTION

The invention relates to an elastic toothbrush. More particularly, the invention relates to an improved elastic toothbrush which can provide better elasticity.

Referring to FIGS. 1 and 2, a conventional elastic toothbrush 1 has a head 17 with a large number of bristles 16 thereon, a neck 15, a connector 13 surrounded by a plurality of rings 14, and a handle 11. The upper and lower surfaces 12 of the handle 11 are non-skid surfaces. The diameter of the connector 13 is almost the same as that of the neck 15. When the head 17 and the neck 15 are bent, the handle 11 will be bent also. The gums may be easily hurt while brushing the teeth. The head 17 is made of hard material, so the gums and the oral cavity may be damaged also.

SUMMARY OF THE INVENTION

An object of the invention is to provide an elastic toothbrush which can protect the gums and oral cavity from damage while brushing the teeth.

Another object of the invention is to provide an elastic toothbrush with rubbers so that the elastic fatigue can be reduced and the period of time of usage can be prolonged.

According to an embodiment of the invention, an elastic toothbrush comprises a head with a large number of bristles thereon, a neck connected to the head, a connector connected to the neck, and a handle connected to the connector. A slot and a groove are formed on the upper surface of the handle. An elongated recess is formed on the lower surface of the handle. The groove and the elongated recess are communicated via a through hole. The slot and the elongated recess are communicated via at least a slant hole. An anti-skid rubber infills the slot. A rubber mark infills the groove. A non-slip rubber infills the elongated recess. A circular recess is formed between the head and the neck. A notch is formed on the distal end of the head. An upper and lower recesses are formed on the rim of the head. The end rubber infills the notch. The circular rubber infills the circular recess. The rim rubber infills the upper and lower recesses. The connector is enclosed by a connector rubber.

Further, the connector can be a straight connector, a concave connector or a zigzag connector. In addition, the cross-sectional shape of the connector can be a circular, rectangular, triangular or hexagonal shape.

The other embodiments provide a head with an upper, middle or lower recess. The recess is filled with the rim rubber also.

DETAILED DESCRIPTION OF THE INVENTION

Figure 1:
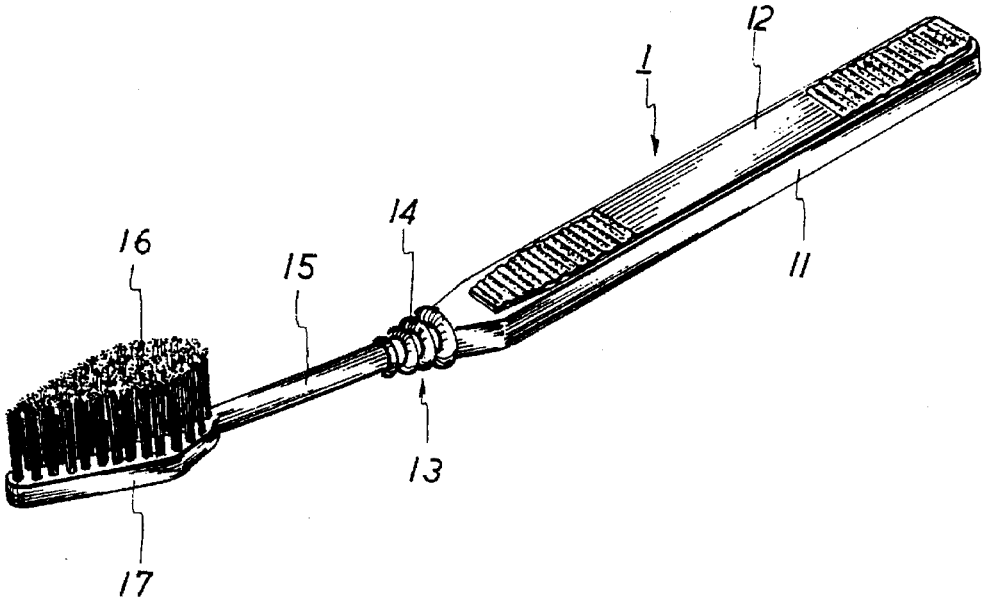
FIG.1 PRIOR ART
FIG. 1 is a perspective view of an elastic toothbrush of the prior art.
Figure 2:
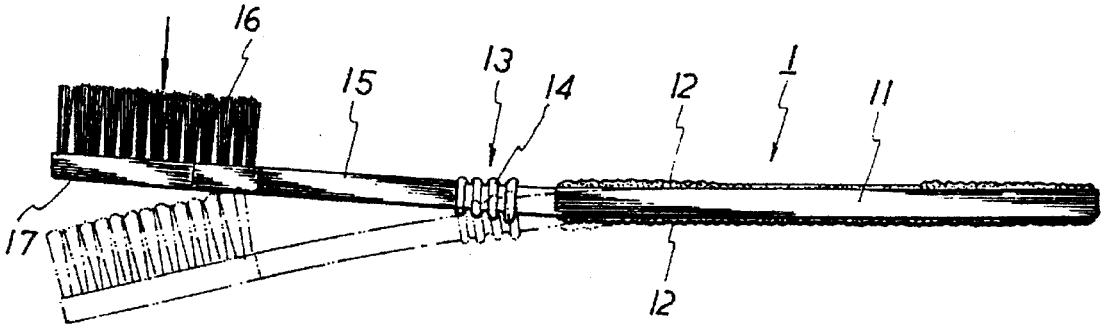
FIG.2 PRIOR ART
FIG. 2 is a schematic view illustrating the operation of an elastic toothbrush of the prior art.
Figure 3:
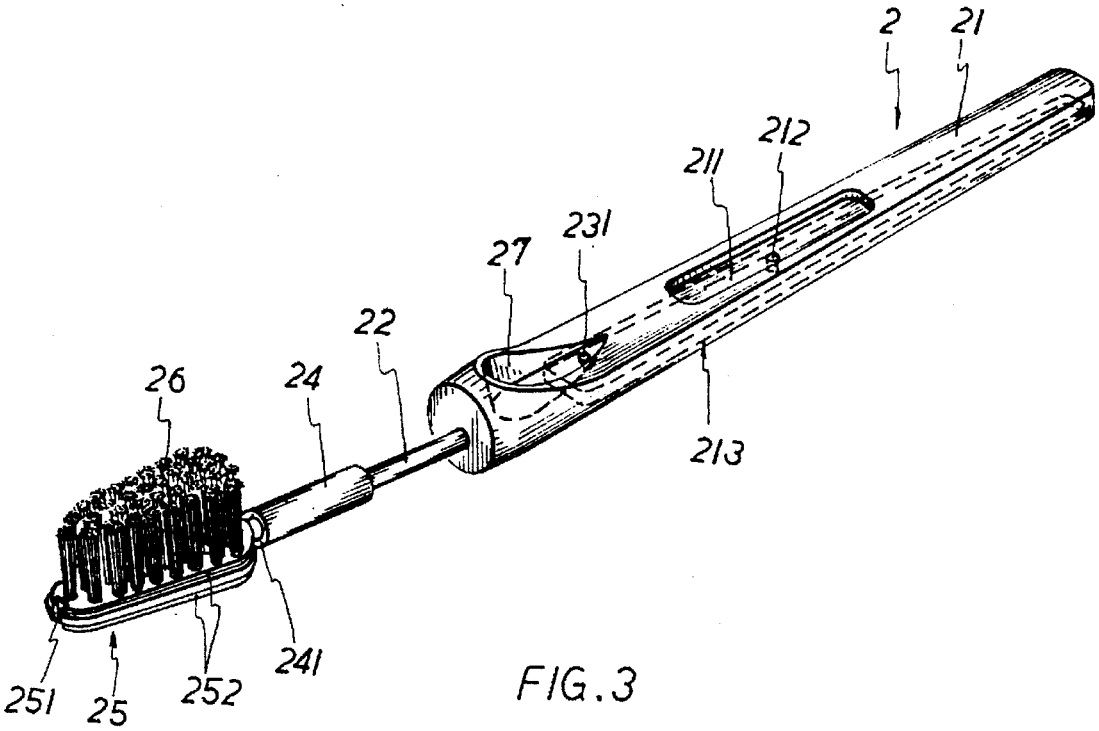
FIG. 3 is a perspective view of an elastic toothbrush without rubbers of a preferred embodiment in accordance with the invention.
Figure 4:
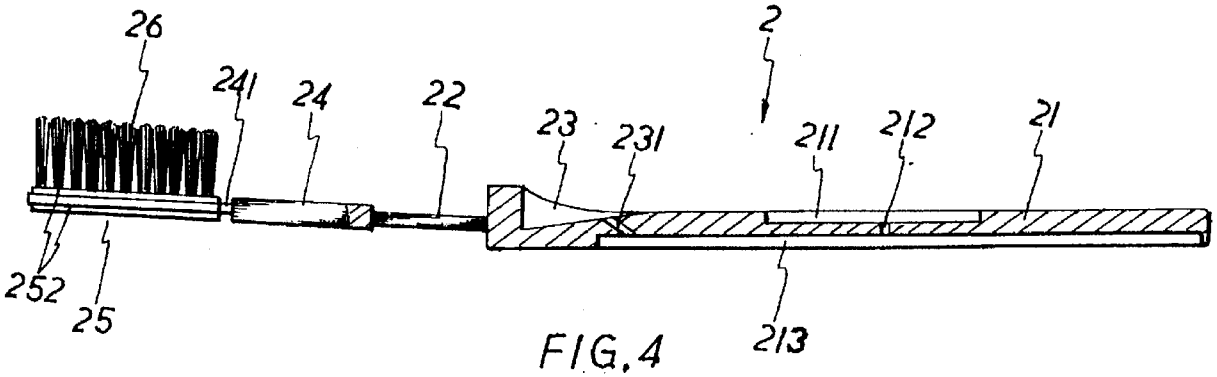
FIG. 4 is a partially cross-sectional view of FIG. 3.
Figure 4A:
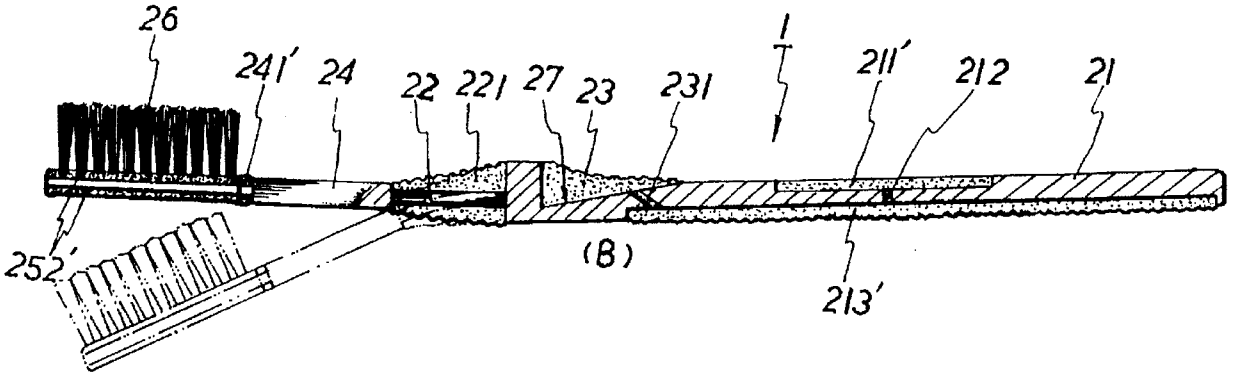
FIG. 4A is a schematic view illustrating the operation of an elastic toothbrush of FIG. 4 with rubbers.
Figure 5:
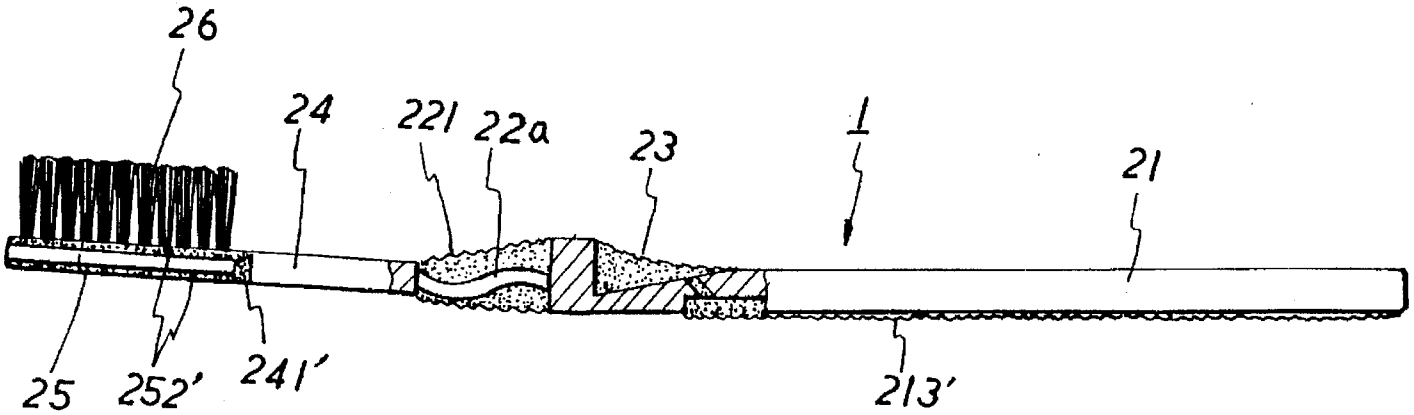
FIG. 5 is a partially cross-sectional view of an elastic toothbrush with a curved connector.
Figure 6:
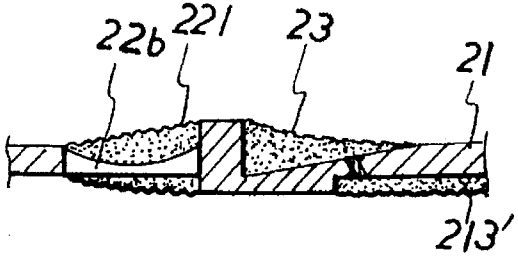
FIG. 6 is a partially cross-sectional view of a concave connector and a proximal end of a handle.
Figure 7:
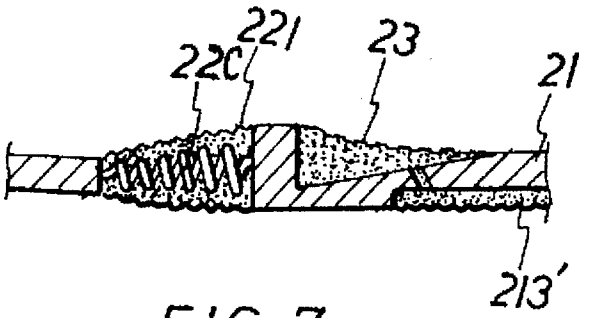
FIG. 7 is a partially cross-sectional view of a zigzag connector and a proximal end of a handle.

Referring to FIGS. 3, 4 and 4A, an elastic toothbrush 2 comprises a head 25 with a large number of bristles 26 thereon, a neck 24 connected to the head 25, a slender connector 22 connected to the neck, and a handle 21 connected to the slender connector 22. A slot 27 and a groove 211 are formed on the upper surface of the handle 21. An elongated recess 213 is formed on the lower surface of the handle 21. The groove 211 and the elongated recess 213 are communicated via a through hole 212. The slot 27 and the elongated recess 213 are communicated via at least a slant hole 231. The rubber latex infills the slot 27, the groove 211 and the elongated recess 213 to form the corresponding anti-skid rubber 23 on the slot 27, non-slip rubber 213' on the elongated recess 213, and rubber mark 211' on the groove 211. A circular recess 241 is formed between the head 25 and the neck 24. A notch 251 is formed on the distal end of the head 25. An upper and lower recesses 252 are formed on the rim of the head 25. The rubber latex infills the notch 251, the circular recess 241 and the upper and lower recesses 252 to form the end rubber (not shown in the figures), the circular rubber 241' and the rim rubber 252'. The connector 22 is enclosed by a connector rubber 221 also.

Referring to FIGS. 9 to 11 and 4A, the connector 22 and the connector rubber 221 are flexible. However, the handle 21 will not be bent while brushing the teeth.

Figure 8B:
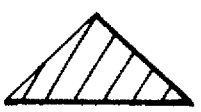
FIGS. 8, 8A, 8B and 8C are cross-sectional profiles of connectors.
Figure 8A:
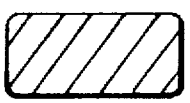
Figure 8:
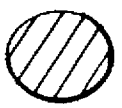
Figure 8C:
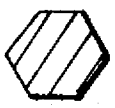
Figure 9:
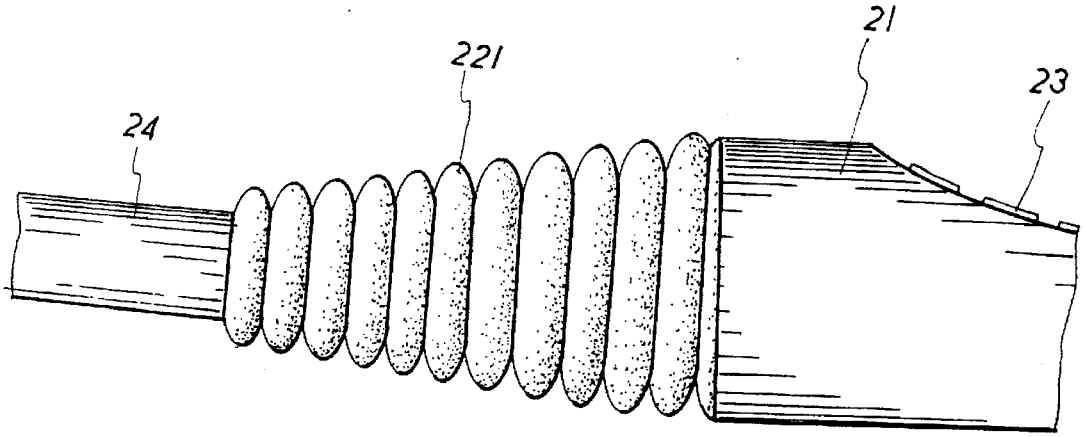
FIG. 9 is a side elevational view of a connector rubber.
Figure 10:
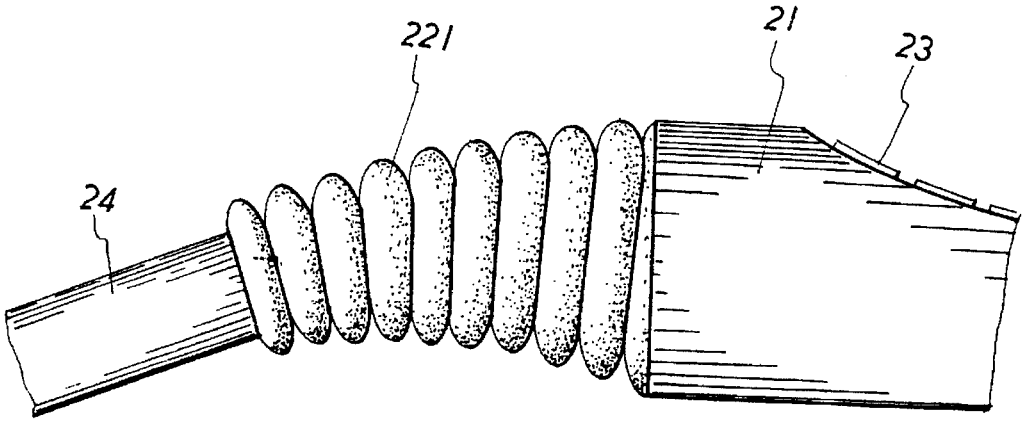
FIG. 10 is a schematic view illustrating the operation of a connector rubber.
Figure 11:
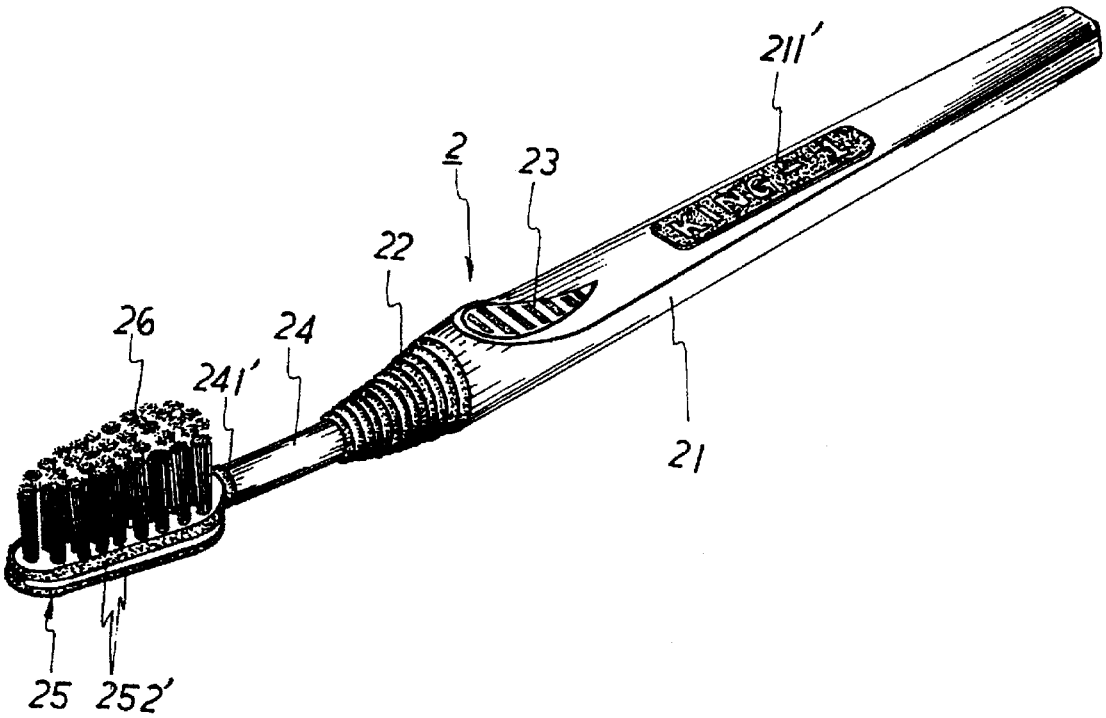
FIG. 11 is a perspective view of an elastic toothbrush with rubbers of a preferred embodiment.

Referring to FIGS. 8, 8A, 8B and 8C, the cross-sectional shape of the connector is in a circular shape (as shown in FIG. 8), a rectangular shape (as shown in FIG. 8A), a triangular shape (as shown in FIG. 8B), or a hexagonal shape (as shown in FIG. 8C).

Figure 12:
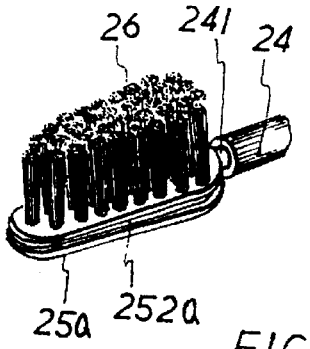
FIG. 12 is a perspective view of a head of the second preferred embodiment.
Figure 12A:
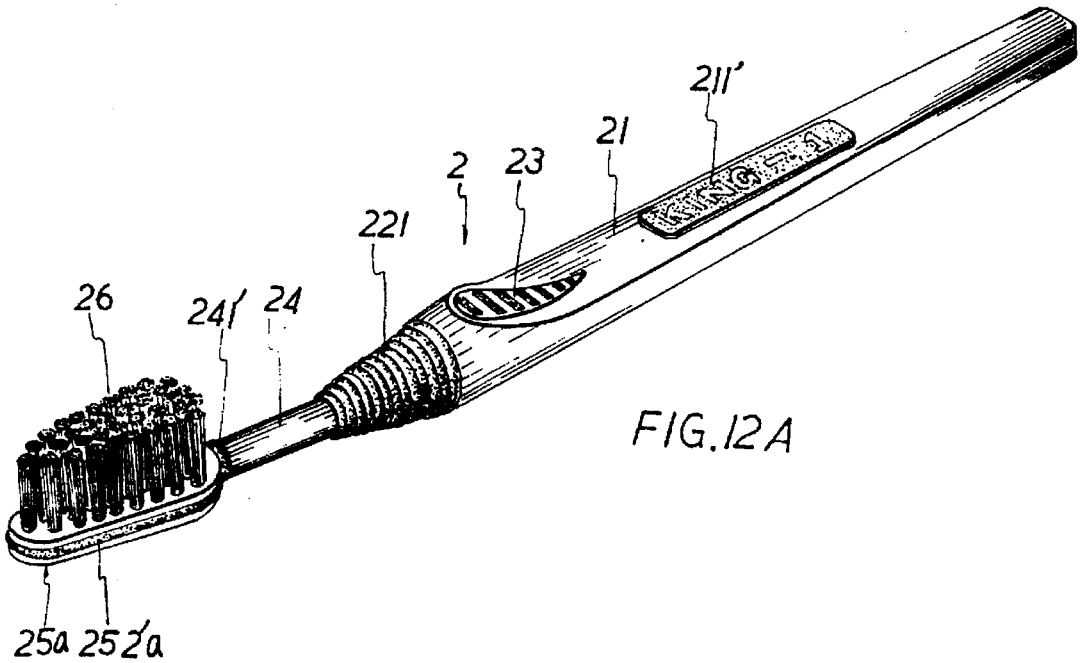
FIG. 12A is a perspective view of the head of FIG. 12 disposed on an elastic toothbrush.

Referring to FIGS. 12 and 12A, the head **25*a* has a middle rim recess 252*a*. The rim recess 252*a* is filled with a rim rubber 252'*a***.

Figure 13:
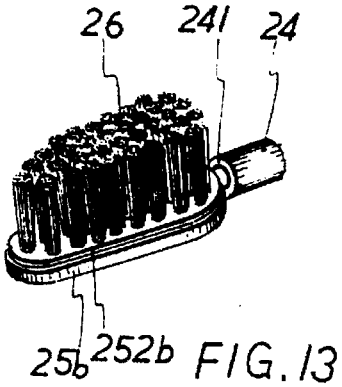
FIG. 13 is a perspective view of a head of the third preferred embodiment.
Figure 13A:
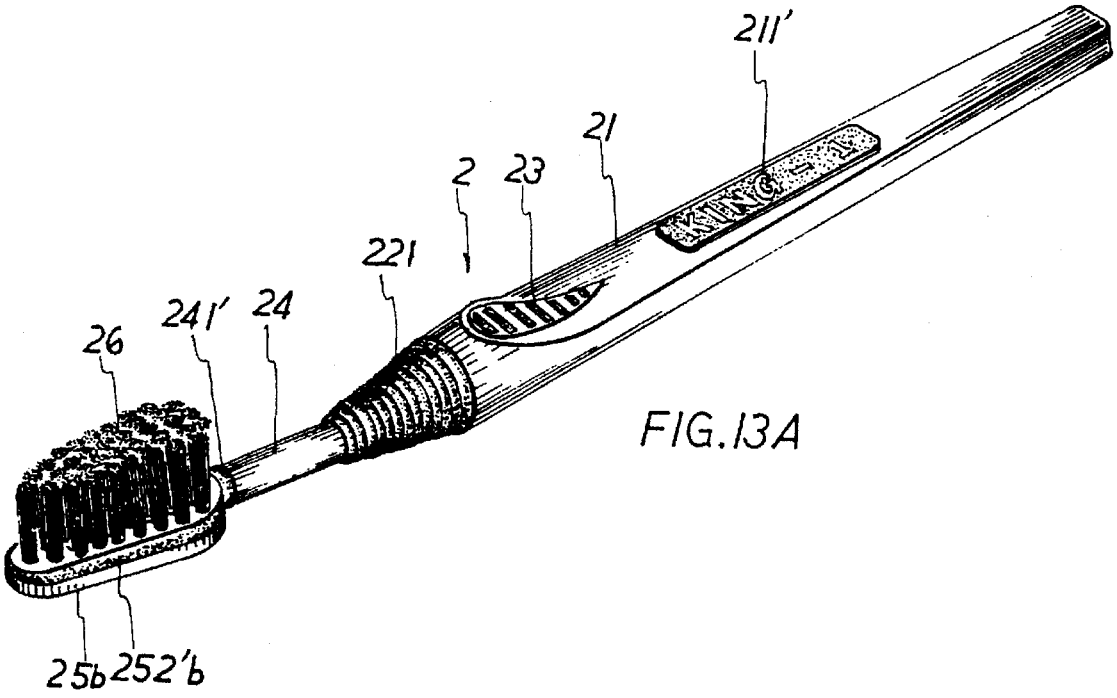
FIG. 13A is a perspective view of the head of FIG. 12 disposed on an elastic toothbrush.

Referring to FIGS. 13 and 13A, the head **25*b* has an upper rim recess 252*b*. The rim recess 252*b* is filled with a rim rubber 252'*b***.

Figure 14:
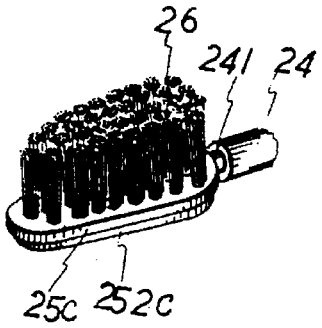
FIG. 14 is a perspective view of a head of the fourth preferred embodiment.
Figure 14A:
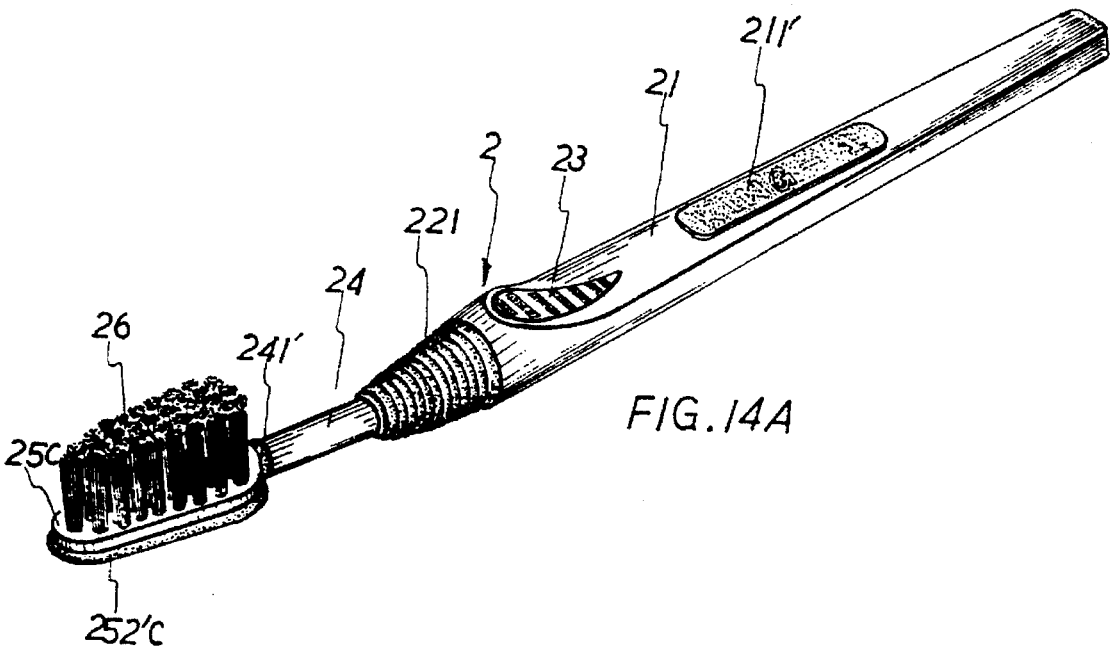
FIG. 14A is a perspective view of the head of FIG. 12 disposed on an elastic toothbrush.

Referring to FIGS. 14 and 14A, the head **25*c* has a lower rim recess 252*c*. The rim recess 252*c* is filled with a rim rubber 252'*c***.

The invention is not limited to the above embodiments but various modification thereof may be made. It will be understood by those skilled in the art that various changes in form and detail may be made without departing from the scope of the invention.

I claim:

1. An elastic toothbrush comprising:

a head with a large number of bristles thereon;

a neck connected to said head;

a connector connected to said neck;

a handle connected to said connector;

a slot and a groove formed on an upper surface of said handle;

an elongated recess formed on a lower surface of said handle;

said groove communicated with said elongated recess via a through hole;

said slot and said elongated recess communicated via at least a slant hole;

an anti-skid rubber infilling said slot;

a rubber mark infilling said groove;

a non-slip rubber infilling said elongated recess;

a circular recess formed between said head and said neck;

a rim recess formed on a rim of said head;

a notch formed on said head;

an end rubber infilling said notch;

a circular rubber infilling said circular recess;

a rim rubber infilling said rim recess; and a connector rubber enclosing said connector.

2. An elastic toothbrush as claimed in claim 1, wherein said connector is in a linear shape.

3. An elastic toothbrush as claimed in claim 1, wherein said connector is in a curved shape.

4. An elastic toothbrush as claimed in claim 1, wherein said connector is in a concave shape.

5. An elastic toothbrush as claimed in claim 1, wherein said connector is in a zigzag shape.

* * * * *